United States Patent [19]

Bice et al.

[11] 4,336,444

[45] Jun. 22, 1982

[54] APPARATUS AND METHOD FOR CONVERTING ELECTRICAL ENERGY INTO HEAT ENERGY

[75] Inventors: Howard W. Bice, Fort Wayne, Ind.; Don W. Williams, Van Wert, Ohio

[73] Assignee: Gust, Irish, Jeffers & Hoffman, Fort Wayne, Ind.

[21] Appl. No.: 111,523

[22] Filed: Jan. 14, 1980

[51] Int. Cl.[3] ..... H05B 1/02

[52] U.S. Cl. ..... 219/505; 62/3; 62/160; 165/104.19; 165/104.33; 219/325; 219/530; 219/540; 219/553; 363/68; 363/13

[58] Field of Search ..... 48/1, 79; 62/3, 134, 62/160; 136/204; 165/105; 219/325, 326, 504, 505, 530, 540, 552, 553; 310/306; 363/141, 67, 68, 13; 338/22 R, 22 DD

[56] References Cited

U.S. PATENT DOCUMENTS

| | | | |
|---|---|---|---|
| 2,739,219 | 3/1956 | Tagliaferri | 219/540 X |
| 2,871,376 | 1/1959 | Kretzmer | 219/505 X |
| 2,872,788 | 2/1959 | Lindinblad | 62/3 |
| 2,919,553 | 1/1960 | Fritts | 62/3 |
| 2,952,786 | 9/1960 | Lewis | 62/3 X |
| 2,959,925 | 11/1960 | Frantts et al. | 62/3 |
| 2,999,971 | 9/1961 | Schnecks | 363/141 |
| 3,536,893 | 10/1970 | Cranley | 219/530 X |
| 3,654,542 | 4/1972 | Chaupit | 363/68 |
| 3,719,796 | 3/1973 | Abiledtrup | 219/504 |
| 4,084,221 | 4/1978 | Ogata | 363/68 X |

*Primary Examiner*—Volodymyr Y. Mayewsky
*Attorney, Agent, or Firm*—Gust, Irish, Jeffers & Hoffman

[57] ABSTRACT

A device and method for converting electrical energy into heat energy including a cascade connection of bidirectional thyristors, such as triacs, operated from an alternating current power supply. The thyristor are submerged in oil which is thermally conductive but electrically insulative, the oil being in initimate contact with the thyristors junctions. The heat energy at the junctions flows to the oil, from there to a heatsink (radiator), and from the radiator to the surrounding atmosphere.

12 Claims, 11 Drawing Figures

APPARATUS AND METHOD FOR CONVERTING ELECTRICAL ENERGY INTO HEAT ENERGY

BACKGROUND OF THE INVENTION

1. Field of the Invention

The present invention relates to devices for converting electrical into heat energy and more particularly to an arrangement of semiconductors operated from an alternating current power supply to generate heat.

2. Description of the Prior Art

It is conventional in the prior art to employ a pure resistance for converting electrical energy into heat energy, the source of electrical energy being either unidirectional or bidirectional. Typical examples are baseboard heaters, heating elements for electric stoves, electric cooking utensils, room heaters and the like. The power dissipation characteristics of such heaters are well known. Other prior art may be found in one or more of the following listed U.S. Pat. Nos. 2,999,971; 2,937,960; 2,872,788; 2,959,925; 3,054,840; 2,919,553; 3,509,386.

SUMMARY OF THE INVENTION

An electrical heater of this invention includes a vessel having a liquid therein which is thermally conductive but electrically insulative. An electrical apparatus for converting electrical energy into heat energy is submerged in such liquid, this apparatus including for one form of the invention a plurality of semiconductive devices, such as triacs, connected in cascade. Resistors are connected between the control gates of the triacs and the adjacent terminals thereof, providing signals which trigger the triacs into conductivity. In particular, the junctions of the triacs are in intimate contact with the liquid such that heat generated thereat is transferred to the liquid.

In a particular embodiment of this invention, the vessel is in the form of an elongated closed tube with the triacs therein being arranged in tandem in an elongated array. Radiating fins are secured in thermally conductive relationship to the tube for receiving heat from the liquid and for radiating the same into the surrounding atmosphere. Semiconductors other than triacs may be used.

In a further embodiment, the energy converter is series connected with a load such as fluorescent lights, the lights emitting essentially normal brightness while the converter produces heat.

It is an object of this invention to provide an apparatus for converting electrical energy into heat energy, wherein semiconductive devices or thyristors are so arranged and controlled in the conductivity thereof as to cause the generation of heat.

It is another object of this invention to provide an apparatus and method for converting electrical energy into heat energy from the current normally drawn by a load in the form of fluorescent lights or the like.

It is yet another object of this invention to provide an apparatus and method for converting electrical energy into heat energy wherein a plurality of triacs are symmetrically connected in cascade in such a manner that heat is generated thereby upon application of a source of electrical power.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
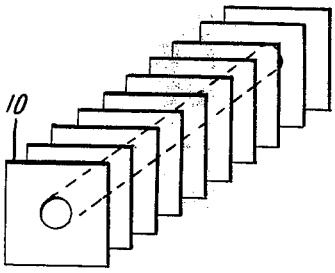
FIG. 1 is a perspective illustration of one embodiment of this invention in the form of an electrical baseboard heater.
Figure 2:
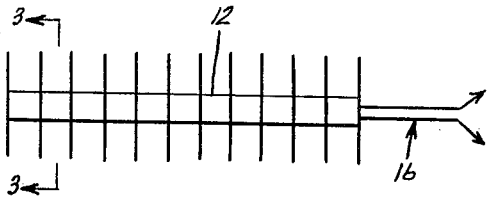
FIG. 2 is a side view thereof.
Figure 3:
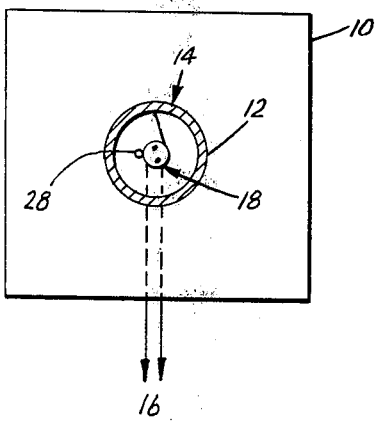
FIG. 3 is a crosssection taken substantially along section line 3—3 of FIG. 2.
Figure 6:
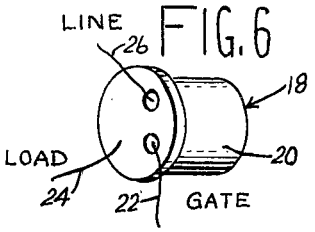
FIG. 6 is a perspective illustration of a typical triac prior to being modified for use in this invention.

One embodiment of this invention is incorporated into a conventional baseboard heater as shown more particularly in FIG. 1–3. This heater includes a plurality of parallel, spaced metallic fins 10 secured to an elongated, hollow tube 12 which is closed at both ends. Tube 12 preferably is of metal with the fins 10 being welded or otherwise secured thereto in good heat exchange relation. The solid-state heating device of this invention as generally indicated by the numeral 14 is disposed within the tube 12 as shown more clearly in FIG. 3 with power leads 16 which are connected thereto and insulated from each other extending through one end of the tube 12 as shown in FIG. 2. The heating device 14 (encompassed within the dashed line rectangle in FIG. 4) includes as a principal component a triac 18, there being a multiplicity of triacs 18 symmetrically connected in series. A triac is a gate-controlled full-wave alternating current silicon switch designed to switch from a blocking state to a conducting state for either polarity of applied voltage with positive or negative gate triggering. A thyristor generically includes triacs and otherwise may be defined as a bistable device comprising three or more junctions. At least one of the junctions can switch between reverse and forward voltage polarity within a single quadrant of the anode to cathode voltage-current characteristics. Specifically, triacs, as one form of thyristor, are used in one embodiment of this invention. Such a triac as is commercially available is indicated by the numeral 18 in FIG. 6, and in this form is provided with a cylindrical metallic housing 20 having the usual leads emerging from one end thereof. For use in this invention, the triac 18 is modified by removing the housing 20 to appear as shown in FIG. 7, the three leads indicated by the numerals 22, 24 and 26 otherwise being conventionally characterized as the gate, load and line terminals, respectively.

Figure 4:
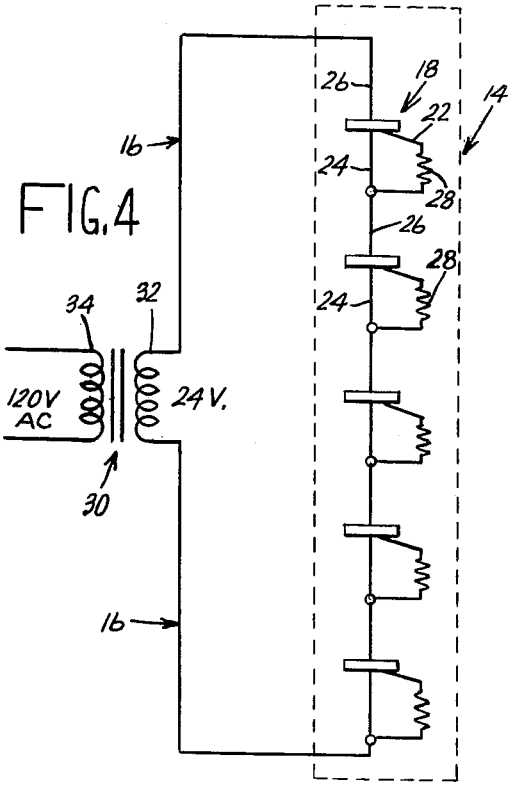
FIG. 4 is a wiring diagram thereof.
Figure 7:
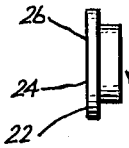
FIG. 7 is a side view of such a triac after being modified.

The triacs modified as shown in FIG. 7 are connected in series as shown in FIG. 4, each triac having a gating resistor 28 connected between the control gate 22 and the load terminal 24 as shown. The series arrangement of triacs 18 with a gating circuit on a common side thereof may thus be considered as being connected in series symmetry with all of the triacs 18 and resistors 28 being of the same type and value.

A source of alternating current power in the form of a transformer 30 is connected across the heating device or array 14 of triacs, the secondary winding 32 providing 24 volts with 120 volts applied to the primary winding 34. Five triacs 18 are shown in the array 14; however other numbers may be used varying from two to twenty without departing from the spirit and scope of this invention. As shown, the connections from triac to triac and from the source 30 of alternating current voltage to the opposite ends of the array 14 of triacs 18 are direct and bi-directionally conductive, meaning that they are conductive of both cycles of alternating current.

In assembling the array 14, the triacs 18 are symmetrically arranged in tandem so as to provide an elongated array or string of components essentially as shown in FIG. 4. This array 14 is inserted into the tube 12 as shown more clearly in FIG. 3 filled with a suitable oil which is thermally conductive but electrically insulative. As explained previously, the tube 12 has its opposite ends sealed with the two leads 16 being insulated from each other. So submerged, the triacs 18 and the junctions thereof are in imminent, heat-exchanging relation with the oil such that heat generated by the triacs themselves will be transferred to the oil, from there to the tube 12 and from the tube 12 through the radiating fins 10 to the atmosphere.

For one embodiment of this invention, the triacs used are Sylvania type ECG5642 rated at 400 volts and 2½ amperes. The gating resistors 28 may have values of resistance varying from 470 ohms to 10,000 ohms, the former value in some instances being preferred.

Figure 9:
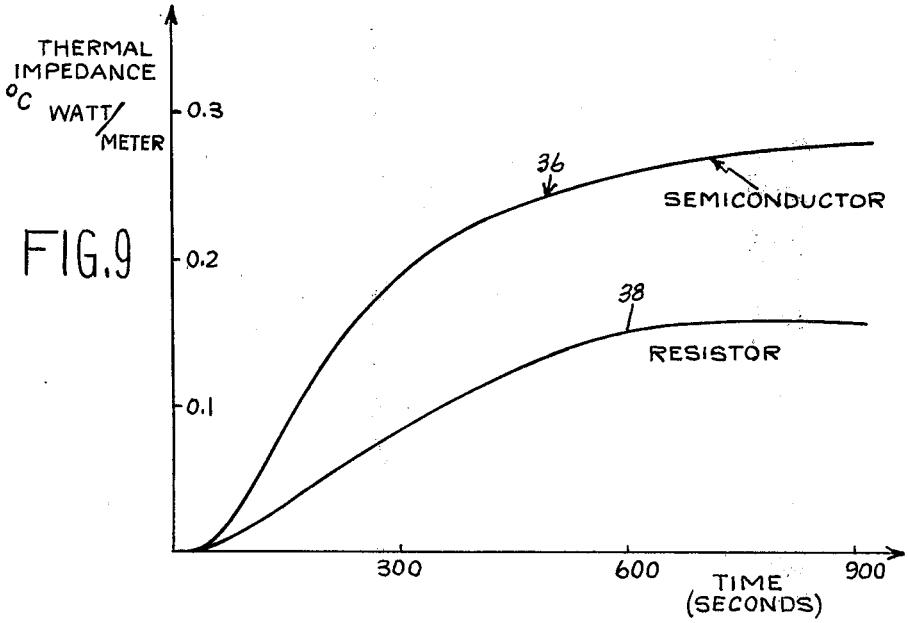
FIG. 9 is a graph used in explaining the operation of this invention.

In operation, power applied to an array 14 of, for example, sixteen triacs results in generation of heat energy which, starting from ambient room temperature provides a thermal impedance characteristic as indicated by the curve 36 in FIG. 9.

The performance of this invention as a heat converter has been experimentally compared with the performance of a conventional wire-resistive element of the type employed in electric coffee makers, the power inputs and operating conditions being maintained as nearly the same as possible. The length of the resistance element was ten and one-half inches, the resistance about one hundred eighty-two ohms, the voltage applied about one hundred nineteen (119) volts a.c. and the current sixty-three (63) milliamperes. For essentially the same operating conditions, FIG. 9 illustrates the performances of one embodiment of this invention by the curve 36 as against the curve 38 for the wire-resistive element just described. Using two different but identically constructed commercial baseboard radiators each 12 inches in length, one equipped with the triac array of this invention and the other the wire-resistive element, experiments were conducted for the purpose of comparing the convective radiation properties thereof. The radiators were installed and operated under essentially equivalent ambient conditions. The thermal impedance observed for the wire-resistive element was 0.148° C./watt/meter which was considered to be experimentally close to the value calculated for a Calrod unit with a 20 ohm resistance of 0.2° C./watt/meter.

One semiconductor array of this invention had an electrical resistance of about 4.5 ohms and produced an overall thermal impedance of about 0.267° C./watt/meter. A thermal impedance of as high as 0.33° centigrade/watt/meter has been measured under similar experimental conditions.

One conclusion from these experiments is that the thermal resistivity for the semiconductor array can be variously estimated to be from 1.3 to two times that of a conventional wire-resistive element, with a specifically observed ratio of 1.56. That is, for the observed experiments, in a commercial baseboard radiator, the semiconductor array causes 1.56 times the temperature rise above ambient as does a wire resistor at essentially the same power level. Furthermore, steady-state temperatures for both are reached after an elapsed time of about 16 minutes, that is with an expenditure, in one case, of 70,000 joules.

Figure 5:
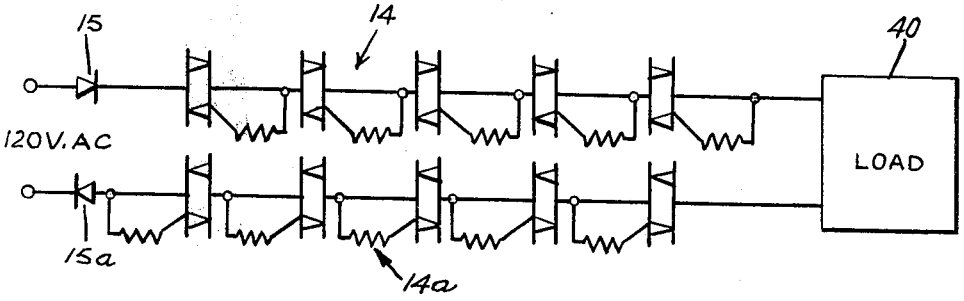
FIG. 5 is a schematic of a slightly different embodiment of this invention.

A further variation of this invention is shown in FIG. 5 wherein the triac arrays are shown in series with both power leads of a load, such as fluorescent lights, indicated by the numeral 40. The triac arrays are indicated by the numerals 14 and **14*a* and may be identical with the exception that the gates are arranged as shown. Diodes 15 and 15*a* are connected as shown. The load 40 may take any conventional form such as electric fluorescent lights or similar electrical appliances. With power applied, the arrays 14 and 14*a*** generate heat which may be transferred to the surrounding atmosphere.

Based on experimental data, more heat can be generated per watt of power using the present invention than is true of the resistive element mentioned earlier. As to the arrangement of FIG. 5, the current drawn by the load 40 in the form of fluorescent lights is utilized by the semiconductors for producing heat. Experiments have shown that the light output changes negligibly, if any, with either or both of the arrays 14 and **14*a* in or out of the circuit. With the array in circuit, useful heat is generated during normal or near normal operation of the lights 40 without any appreciable increase in power consumed. This is believed to result from the minimal electrical resistance of the array (4.5 ohms, for example) across which the resulting voltage drop is small or negligible. Almost full voltage and current are still applied to the lights 40 even though the arrays 14 and/or 14*a* are functioning to produce heat. This is in sharp contrast with the substantial voltage drop which would occur across a wire resistance element as earlier described, in series with lights 40, this drop being of a magnitude as would deleteriously affect the operation of lights 40, especially as to the brightness output. In effect this facet of the invention comprehends the utilization of load current to produce useful heat without affecting more than minimally the proper functioning of the load. In one experiment, the load 40 consisted of five 40 watt fluorescent and one 150 watt incandescent bulb, which normally consumed 350 watts. The power consumption did not change with either or both arrays 14, 14*a* having thirty triacs in circuit and mounted in a radiator 10 thirty inches long which developed 1500 BTU's. The light output of the load 40** remained essentially the same, the drop being hardly measureable with a conventional light meter.

Experiments have shown that as few as two and as many as twenty triacs may be used in a single array. Also, as mentioned previously, the values of the gating resistors may be changed. Even still further, it has been learned that triacs may be triggered into conductivity without the control gates being connected into circuit by applying heat thereto which raises the temperature to a suitably elevated value. Thus, any suitable means for triggering the triacs into operation may be used without departing from the spirit and scope of this invention.

Figure 10:
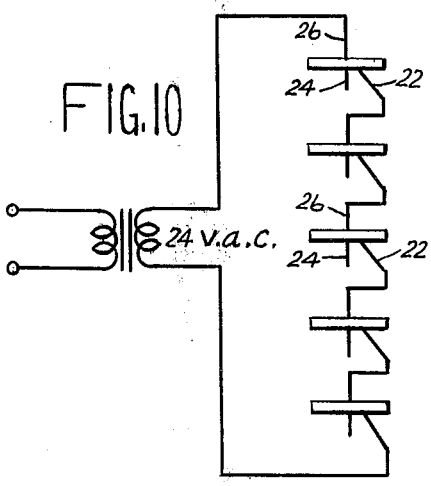
FIG. 10 is a wiring diagram of another embodiment of this invention.

Another embodiment is shown in FIG. 10 wherein the triacs 18 are in series with connections between the gates 22 and line terminals 26. The load terminals 24 are not connected. Heat generated by this array was essentially the same as that of the preceding arrangements.

Figure 11:
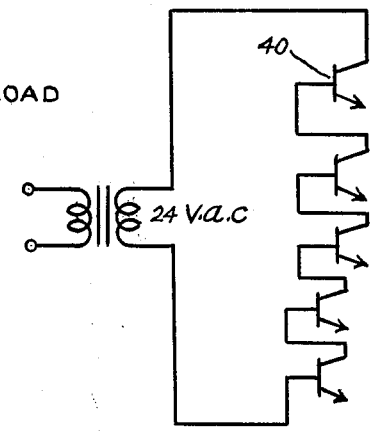
FIG. 11 is a similar diagram of yet another embodiment of this invention.

A still further embodiment in FIG. 11 utilizes silicon transistors 40 in series connected as shown, the emitters being unconnected. This arrangement also generated heat to an extent comparable with the foregoing embodiments.

The voltages and currents applied to all three of the embodiments of FIGS. 4, 10 and 11 were essentially the same, the currents through the semiconductors being higher than rated. In all instances, the semiconductor arrays were submerged in oil contained in vessel 12.

The transistor types employed were Type PNP 2N5855.

Figure 8:
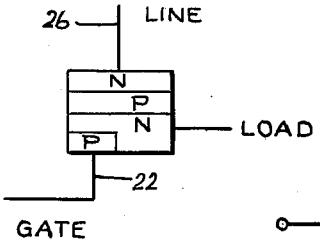
FIG. 8 is diagrammatic illustration of a typical triac.

As to the arrangement of FIG. 10, connecting the load line 24 into the circuit and leaving the gate 22 disconnected results in the generation of less heat to the extent of not being considered desireable. The same result obtains as to FIG. 11 with the emitters in circuit in place of the collectors. The reasons for these results are not presently understood. In common, however, as to the triac and transistor is the fact that both have three or more semiconductive regions, which distinguishes them from diodes, also found, as to those tested, not to produce any appreciable heating. The construction of a typical silicon triac having multiple "P" and "N" layers or regions is diagrammatically shown in FIG. 8.

In any event, it appears that those portions of the triac and transistor which do function to produce appreciable heat constitute what may be termed a "heating section". Semiconductive devices other than triacs and transistors may also embody like heating sections; however, such other devices are not presently known. Therefore, in the claims appended hereto, that portion of the semiconductive device which does produce the desired heating will be referred to as the "heating section".

In the circuitry, the selected value of the alternating current voltage coupled with the impedance of the heating section provides a current through the latter at a level which is believed to maximize the heating effects or power loss. The phenomenon of heating of the semiconductor is utilized, it being well known that in conventional circuits heating does occur and that if it exceeds a predetermined level will result in damage or improper operation. Such heating is considered undesirable in the usual instance.

In this invention, such heating is desired and is maximized to the extent possible. By the use of the circuitry disclosed, the semiconductor is operated to generate useful heat over and above that normally developed, the current through the semiconductor being greater than considered normal.

While not completely understood, an abbreviated, proposed theory of operation is offered in the following. A power semiconductor bidirectional thyristor in the form of a tirac exploits the combination of junction gate control, remote gate control and conventional thyristor action, resulting in a bidirectional triode switch that is capable of direct operation from an alternating current power supply. The voltage-current characteristics are almost perfectly symmetrical. Lack of device symmetry is observed however in the gate input characteristic. (F.E. Gentry et al, "Bidirectional Triode P-N-P-N Switches", Proceedings IEEE 53, No. 4, pp 355–369 (1965)

Static resistance exhibits a negative temperature characteristic (resistance decreases with temperature increase). Dynamic resistance at low currents is negative while at large currents approaches 0.027/I. At intermediate currents, there is a point at which dynamic resistance is zero. (A. van der Ziel, Solid State Physical Electronics, 2nd Edition, Prentice-Hall, Englewood Cliffs, N.J., 1968, p. 440)

In conventional circuits, triacs are operated in such a manner that the applied currents will not result in excess junction temperatures. In the present invention, these considerations are in the main inappropriate, it being an objective to generate as high temperature as possible without exceeding the structural limitations of the device. With the housing of the triac removed, as otherwise shown in FIG. 7, the heat arising at the junctions due to forward conduction losses flows to the oil and from there to the heatsink (radiator), and from the radiator to the surrounding atmosphere. The difference in temperature between the junction and the ambient, under steady-state conditions, is given by the equation: $T_j - T_a = \theta P_{Are}$°C., where $\theta$ is the thermal impedance in degrees celsius per watt. (W.H. Hayt, Jr. and G.N. Neudeck, Electronic Circuit Analysis and Design, Houghton-Mifflin, Boston, 1976. pp. 119–120) It is estimated that at the thermal impedance for one structure is approximately 0.6° C./watt. However, it has been learned that this will vary depending upon the numbers of triacs used in an array, the values of the gating resistors and the types of triacs used.

In summary, by tuning the triacs such that the internal dynamic resistance is negligible and the static resistance at the operating temperature is low, the forward current losses at the junction can be converted into heat which can be transferred through a commercial baseboard heater with reasonably high efficiency. One possible explanation for the observed phenomenon is that, at a forward break-over voltage of about two volts, the triac reverses voltage direction, which causes an impulsive change in current across the junction. The high current at reversal every half cycle contributes a large $I^2R$-heat loss which is dissipated into the heatsink radiator.

While there have been described above the principles of this invention in connection with specific apparatus, it is to be clearly understood that this description is made only by way of example and not as a limitation to the scope of the invention.

What is claimed is:

1. A heat-generating apparatus for converting electrical energy into heat energy comprising semiconductor means having a plurality of more than two semiconductor regions with junctions therebetween, a first of said regions serving as a control element, said first region in combination with a second region and other regions and junctions therebetween constituting a heat-producing section of said semiconductor means when an alternating current voltage of predetermined magnitude is connected thereacross, an alternating current voltage source connected to said first and second regions, the connections between said source and said first and second regions being bi-directionally conductive, said alternating current voltage and the impedance of said heating section providing a current through the latter at a value which maximizes the power loss thereacross thereby raising the temperature thereof to a predetermined level, and means proportioned and arranged for transferring the heat generated at a rate that maintains such power loss but prevents exceeding the same to an extent as will damage said semiconductor means.

2. The apparatus of claim 1 wherein said semiconductor means includes a plurality of semiconductor devices having said regions, said devices being connected in series by means of connections that are bi-directionally conductive, and said source being connected thereacross.

3. The apparatus of claim 2 wherein said semiconductor devices are triacs series connected in symmetry with the first region of each being the gate, each second region having a line terminal, the gate of one triac being connected to the line terminal of the adjacent triac, said connections being bi-directionally conductive.

4. The apparatus of claim 2 wherein said semiconductor devices are triacs series connected in symmetry with the first region of each being the gate, each second region having a line terminal and each third region thereof having a load terminal, the line terminals of the triacs being series connected with the load terminals, and triggering resistors directly connected between the gates and load terminals, one resistor for each triac.

5. The apparatus of claim 4 including a load connected in series between one side of said source and said triacs.

6. The apparatus of claim 5 including a second plurality of said triacs connected as aforesaid in series between the other side of said source and said load.

7. The apparatus of claim 2 wherein said heat-transferring means includes a vessel containing an insulative liquid in which said semiconductor devices are submerged.

8. The apparatus of claim 7 wherein said vessel is elongated and said semiconductor devices being arranged in tandem in an elongated array, and radiating fins secured to said vessel.

9. A heat-generating apparatus for converting electrical alternating energy into heat energy comprising a plurality of series connected semiconductors each having a negative resistance temperature characteristic, each semiconductor having a heating section with the heating sections of all of the semiconductors being connected in series with the series connections being bi-directionally conductive, and means for collecting and dissipating the heat generated by said semiconductors at a predetermined rate.

10. The apparatus of claim 9 wherein said semiconductors are triacs and the line and load terminals thereof being in series, the gates of each being directly connected to the respective load terminal by means of a gating resistor.

11. The apparatus of claim 9 wherein said semiconductors are triacs and the line and gate terminals directly connected in series, the load terminals being unconnected.

12. The apparatus of claim 9 wherein the semiconductors are silicon transistors and the base and collectors being connected in series, the emitter terminals being unconnected.

* * * * *